United States Patent [19]

Bunger

[11] 4,439,117

[45] Mar. 27, 1984

[54] VARIABLE DISPLACEMENT VANE PUMP

[75] Inventor: Dennen J. Bunger, Clinton, N.Y.

[73] Assignee: The Bendix Corporation, Teterboro, N.J.

[21] Appl. No.: 409,006

[22] Filed: Aug. 17, 1982

[51] Int. Cl.[3] ..... F04C 2/00; F04C 15/04

[52] U.S. Cl. ..... 418/22; 418/219

[58] Field of Search ..... 418/22, 219, 23, 217

[56] References Cited

U.S. PATENT DOCUMENTS 2,570,411 10/1951 Vickers ..... 418/22

2,790,391 3/1957 Holl ..... 418/22

*Primary Examiner*—John J. Vrablik

*Assistant Examiner*—John J. McGlew, Jr.

*Attorney, Agent, or Firm*—Anthony F. Cuoco; Thomas L. Adams

[57] ABSTRACT

A variable displacement vane pump has a ported casing (10), a rotor (28) and a first (32*a*) and second (32*b*) plurality of vanes. The ported casing (10) has a pair of relatively rotatable, complementary cams (18, 20). Each cam has a surface shaped to provide a curvilinear annular track (18*a*, 20*a*). The rotor (28) is rotatably mounted in the casing (10). The vanes (32*a*, 32*b*) are slidably mounted upon the rotor (28). Each of the vanes (32*a*, 32*b*) are sized and positioned to engage a corresponding one of the pair of cams (18, 20). The vanes of the first plurality (32*a*) of vanes engage one of the cams (18), the other cam (20) being engaged by the vanes of the second pluarlity (32*b*). Thus constructed, the vanes (32*a*, 32*b*) can move in pairs in a closed path within the casing (10). The vanes (32*a*, 32*b*) of each pair can ride on different ones of the cams (18, 20). By rotating the cams (18, 20) with respect to each other, the phasing of the vanes (32*a*, 32*b*) in each pair can be altered. This phasing change varies the displacement of the pump.

15 Claims, 8 Drawing Figures

FIG. 1
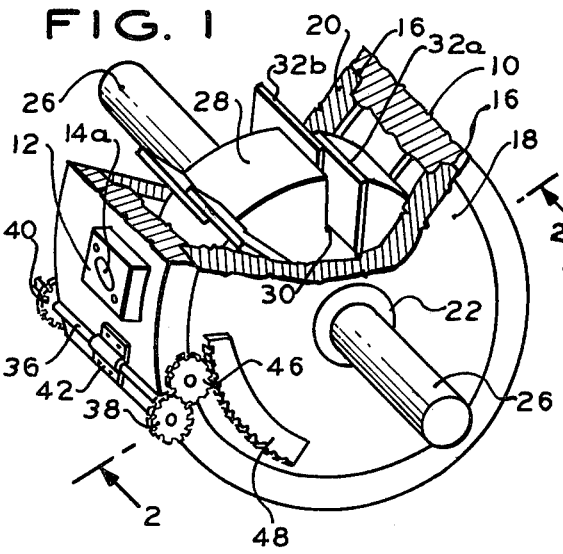
FIG. 2
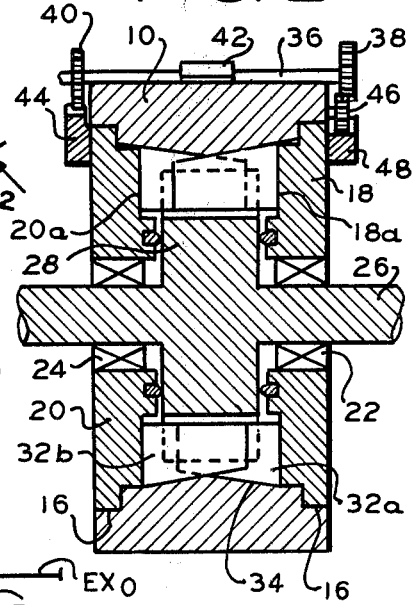
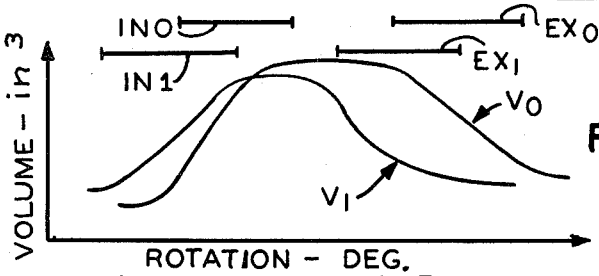
FIG. 5
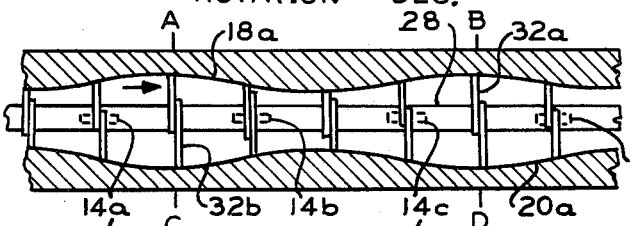
FIG. 4A
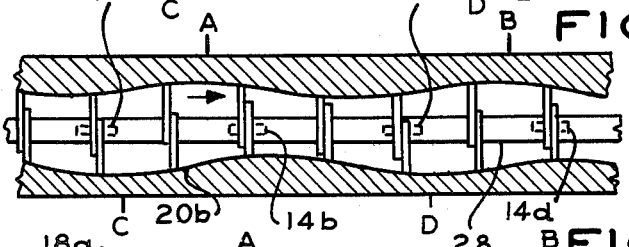
FIG. 4B
FIG. 3A
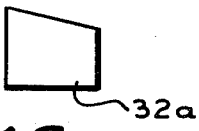
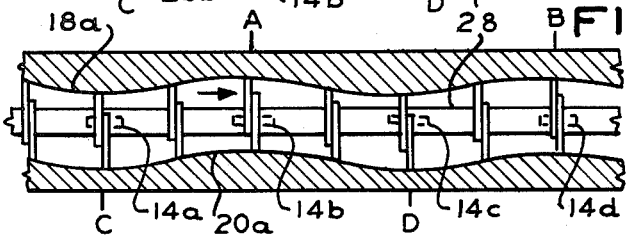
FIG. 4C
FIG. 3B
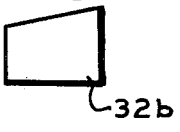

VARIABLE DISPLACEMENT VANE PUMP

BACKGROUND OF THE INVENTION

The present invention relates to variable displacement pumps having reciprocatable vanes.

Vane pumps are well known. In a very simple form, a pumping rotor carries vanes around a casing having a cylindrical volume which is eccentric to the center of rotation of the rotor. This eccentricity results in the volume between vanes changing cyclically. With ports in the casing positioned appropriately, the changing volume between vanes can cause pumping. In a known rotary pump, the extent of eccentricity between rotor and casing can be changed to alter the pumping displacement.

Another known pump employs a rotor having along its periphery axial slots carrying vanes which are axially reciprocatable within the slots. A coaxial cam in the shape of a truncated cylinder lies alongside these vanes and directs their axial reciprocation at the rate of one cycle per revolution of the rotor. While this arrangement can be set to change the phasing of the vanes and the associated volume between them, this phasing change has some disadvantages. When the phasing is changed to reduce pump displacement, the fluid being pumped is pressurized and depressurized non-productively, thereby increasing the load on the various moving parts and pump bearings.

Another known fluid motor or pump has a duplex construction. This construction includes two cams on opposite sides of a blade carrier, forming two working chambers. The blade carrier has two circumferential series of separate blades. However, this known device does not provide for relative rotation between the different cams to change the displacement of a pump. Thus this design suffers the unnecessary loading mentioned previously.

It is also known to alter the displacement of a vane pump by distorting the surface of its cam. A disadvantage with such distortions is that the peak acceleration and thus the forces applied to the vane varies significantly as the cam is distorted. Thus vane wear increases as the cam is distorted to non-ideal configurations.

Accordingly, there is a need for a variable displacement vane pump which has a cam surface that does not create undue acceleration and stress. The displacement of this pump should be variable without inducing non-productive compression and decompression of fluids that can cause unnecessary stress and wear. Furthermore the pump ought to be simple, efficient and reliable.

SUMMARY OF THE INVENTION

In accordance with the illustrative embodiment demonstrating features and advantages of the present invention, there is provided a variable displacement vane pump having a ported casing and a rotor rotatably mounted in the casing. The casing includes a pair of relatively rotatable, complementary cams. Each cam has a surface shaped to provide a curvilinear annular track. The pump also includes a first and second plurality of vanes slidably mounted upon the rotor. Each of these vanes is sized and positioned to engage a corresponding one of the pair of cams. The vanes of the first plurality engage one of the cams, vanes of the second plurality engaging the other one of the cams.

Also in accordance with a related method of the same invention, variable displacement pumping is accomplished with a plurality of pairs of reciprocatable vanes that are rotatably mounted in a ported casing. The casing has a pair of rotatable cams. The method includes the step of moving each pair of vanes in a closed path within the casing. The vanes of each pair ride on different ones of the cams. The method also includes the step of rotating the cams with respect to each other to alter the phasing of the vanes in each pair.

By employing such apparatus and method a relatively simple, efficient and reliable variable displacement pump is provided. In a preferred embodiment, a cylindrical rotor having radial slots carries in each slot a pair of vanes. In this preferred embodiment, vanes can engage camming walls on either side of the pair of vanes. The camming walls are part of a hollow cylindrical casing having intake and discharge ports. Due to the varying thickness of the camming walls, a varying volume exists between vanes. Since the volume varies as the vanes revolve, the pump can displace fluids from one port to the other. In this preferred embodiment, the vanes are axially reciprocatable.

When the cams are oriented such that minimum and maximum vane travel occurs directly opposite each other, the net displacement is maximum. However, in the preferred embodiment the cams can be rotated with respect to the ports in opposite and equal directions. As a consequence the volumes are out of phase and the net volume is decreased. However this interference means that the pump does not create unnecessary pressure. Therefore, the stress and wear on the various components and bearings of the pump does not rise unacceptably.

BRIEF DESCRIPTION OF THE DRAWINGS

The above brief description as well as other objects, features and advantages of the present invention will be more fully appreciated by reference to the following detailed description of the presently preferred but nonetheless illustrative embodiment in accordance with the present invention when taken in conjunction with the accompanying drawings wherein:

FIG. 1 is a perspective view of a pump according to the principles of the present invention with a portion of the casing broken away for illustrative purposes;

FIG. 2 is a cross-sectional view of the pump of FIG. 1 taken through its axis;

FIGS. 3*a* and 3*b* are plan views of the vanes in the pump of FIG. 1;

FIGS. 4*a*, 4*b* and 4*c* are schematic illustrations in the nature of a development, showing the sequence of operation of the pump of FIG. 1 under maximum, moderate and minimum pumping conditions, respectively; and FIG. 5 is a graph showing the inter-vane volume as a function of vane rotation with respect to the ports.

DETAILED DESCRIPTION OF PREFERRED EMBODIMENT

Referring to FIGS. 1 and 2, a variable displacement pump is shown therein as a ported casing having an annular frame 10. A rectangular boss 12 has a port 14*a* which communicates to the inside of frame 10. In this embodiment, four orthogonal ports are employed and although other numbers may be used in different embodiments, an even number is preferred. Frame 10 has a rectangular notch or step 16 cut onto both of its inside corners. Fitted within steps 16 of frame 10 are a pair of complementary, disc-like cams 18 and 20, each having perimeters matching steps 16. Cams 18 and 20 have on their opposite inside surfaces camming walls 18*a* 20*a*, respectively. In each of the cams 18 and 20, there is a concentric hole into which bearings 22 and 24, respectively, are mounted.

Rotatably mounted within bearings 22 and 24 is a shaft 26 which is integral to and coaxial with rotor 28. Rotor 28 is a metal cylinder having eight equiangularly spaced slots 30. Of course this number can vary in other embodiments. In this embodiment, slots 30 are radially aligned with shaft 26, and their axial lengths are such that they run the entire axial length of rotor 28. Mounted in each of the slots 30 are a pair of vanes 32*a* and 32*b* which engage cams 18 and 20, respectively. Vanes 32*a* and 32*b*, shown in plan view in FIGS. 3*a* and 3*b*, respectively, have the form of a trapezoid with two adjacent corners being right angles. It is preferred that vanes 32*a* and 32*b* be constructed identically, the apparent difference in FIGS. 3*a* and 3*b* being only that one is flipped with respect to the other.

A bias means is shown herein as the inwardly peaked, annular, inside surface 34 of frame 10. As shown most clearly in FIG. 2 the slope of surface 34 is chosen to match the slant on the outer edges of vanes 32*a* and 32*b*. As will be apparent from subsequent description, centrifugal and pressure forces cause vanes 32*a* and 32*b* to ride on surface 34 in such a manner that they are thrusted axially outward and apart to ensure vanes contact their respective cam surfaces.

A linkage means is shown herein as a gear train including axle 36 having on one of its ends a gear 38 and another gear 40 located between the ends of axle 36. Gears 38 and 40 are positioned to straddle the girth of frame 10. Axle 36 is suitably secured to the outside of frame 10 by clip bearing 42. Gear 40 engages an arcuately shaped rack 44, shaped similar to rack 48. Gear 38 engages idler 46 which then engages rack 48. Racks 44 and 48 are affixed to the outside surfaces of cams 20 and 18, respectively. Idler 46 is journaled in the side of frame 10.

The annular cam surfaces 18*a* and 20*a* cut on the inside surfaces of cams 18 and 20, respectively, undulate and control the respective vane travel. The undulation will vary from other angularly spaced radii.

Referring to FIG. 4*a* the undulation provided by cam surfaces 18*a* and 20*a* is schematically illustrated in the development of this Figure. This undulation is shown as approximately sinusoidal but of course other shapes may be employed to optimize the accelerations. The above development may be considered a cutaway view with frame 10 removed but with its four orthogonal ports 14*a*, *14b*, 14*c* and 14*d* still illustrated in phantom. Ports 14*a* and 14*c* are inlet ports while ports 14*b* and 14*d* are outlets. Rotor 28 and vanes 32*a* and 32*b* are also spread out by the development.

To facilitate an understanding of the principles associated with the foregoing equipment, its operation will now be briefly described. As the shaft 26 is spun, centrifugal force initially drives vanes 32*a* and 32*b* outwardly against peaked surface 34. Due to the slant on peak 34 and the matching slant on vanes 32*a* and 32*b*, the latter are driven axially outward to form a close seal along peak 34 and along cam walls 18*a* and 20*a*. However, once the pressure between vanes increases, there will be a net pressure tending to drive vanes 32*a* and 32*b* to the positions illustrated. Once the surfaces of vanes 32*a* and 32*b* commence touching peak 34 and cam walls 18*a* and 20*b*, the covered surface area is no longer fully available to receive the pressure of fluids within. Accordingly, the pressure acting on the opposite edges tend therefore to keep vanes 32*a* and 32*b* in the illustrated positions.

It will be assumed that cams 18 and 20 are initially positioned to constructively produce a maximum pumping volume. This occurs when the maximum (and minimum) travel of the respective vanes are directly opposite to each other. Referring to the vanes in the immediate vicinity of port 14*a*, if rotor 28 moves in the direction indicated (from right to left) the volume between the vane pairs 32*a* and 32*b* will increase. Significantly the inter-vane volume on either side of rotor 28 increases synchronously. Therefore, the chambers on either side of rotor 28 work constructively to produce maximum suction at inlet 14*a*. On the other hand, the inter-vane volume in the immediate vicinity of port 14*b* decreases as the rotor rotates in the indicated direction. Accordingly, the decreasing volume produces an outflow or pumping action. Therefore at least a portion of the fluid taken in at inlet 14*a* is discharged through outlet 14*b*.

It will be apparent that this cycle then repeats with port 14*c* acting as an inlet (due to the increasing volume) and port 14*d* acting as an outlet (due to the decreasing volume).

It will be appreciated that in the vicinities between ports 14*a*, 14*b*, 14*c* and 14*d*, the volume between vanes changes the least, so there is no non-productive compression or decompression of fluid in these vicinities. This feature assures that unnecessary component and bearing stress is avoided.

It will now be assumed that shaft 36 (FIG. 1) is rotated to cause the relative shifting of cam surfaces 18*a* and 18*b* with respect to the ports 14*a*–14*d* illustrated in FIG. 4*b*. This relative shifting can be appreciated by noting how stations A and B have moved with respect to stations C and D as illustrated in FIGS. 4*a* and 4*b*. These stations indicate points of maximum vane displacement in the cams 18 and 20. In the example of FIG. 4*b*, cams surfaces 18*a* and 20*a* have each moved approximately 22° with respect to the ports, causing a net relative shift between the cams of approximately 45°.

Significantly, in the region between ports 14*a*–14*b*, there is a tendency for the changing volumes on either side of the rotor 20 to cancel. The displaced cam lobes cause differing rates of change in the volumes on either side of the rotor resulting in a reduction in the net volume between adjacent vane pairs. It can be appreciated that the volumes on either side of the rotor communicate between the outer perimeter of the rotor and inner perimeter of the frame. It will be observed that the maximum volume at station C which corresponds to the minimum change in volume, occurs in the vicinity of port 14*a*. Accordingly, intervane volumes at station C maximum cannot produce their maxmum suction. Similarly with respect to outlet 14*b* the cam surfaces 18*a* and 20*a* have maximum and minimum, respectively, volumes occurring in the vicinity of port 14*b* so that less than maximum discharge occurs.

Significantly, in the region between ports 14*a*–14*b*, there is a tendency for the changing volumes on either side of rotor 28 to cancel. Cam wall 20*b* may cause decreasing volume while that of wall 18*a* is increasing, and vice versa. This feature results in a moderation of non-productive compression and decompression of fluids trapped between ports. It will be appreciated that the volumes on either side of rotor 28 can interfere since there is a clear communication through the space between the outer perimeter of rotor 28 and the inner perimeter of frame 10 (FIG. 2).

Referring to FIG. 5, these volume variations are graphically illustrated for the case of maximum pumping action (graph V0) and moderate pumping action (graph V1). The curves V0 and V1 correspond to the circumstances illustrated in FIGS. 4*a* and 4*b*, respectively. Each of these curves indicate the net volume, that is, the volume on both sides of rotor 28. For graph V0, it is associated inlet and outlet dwell angles are indicated by intervals IN0 and EX0, respectively. It will be noted that the maximum volume is centered between inlet interval IN0 and outlet interval EX0. Accordingly, no excessive compression or decompression occurs between these intervals. Referring to graph V1, it will be observed that its peak is also centered between its inlet interval IN1 and its outlet interval EX1. Again the system avoids nonproductive pressure changes. It will be noted however, that the amplitude of the graph V0 exceeds that of graph V1, and that area under the curve V0 is greater than that of V1, indicating that the latter represents a lesser displacement (volume) than the former.

Referring finally to FIG. 4*c*, cam walls 18*a* and 20*a* have been rotated 45° with respect to the ports so that the relative misalignment between cams is 90°. This results in a net cancellation of the volume changes on either side of rotor 28. Since the volume on one side of rotor 28 changes by the same but opposite amount as that on the other side, there can be no pumping action. Therefore, the pump in this situation produces no effect other than to rotate fluids contained therein.

It will be obvious that other settings of cams 18 and 20 intermediate the maximum, moderate and minumum settings illustrated in FIGS. 4*a*, 4*b* and 4*c*, respectively, are possible. It will be understood therefore that the displacement volume of the pump can be continuously adjusted.

It is to be appreciated that various modifications may be implemented with respect to the above described preferred embodiment. For example, the number of vanes and the number of ports can be varied depending on the desired pumping volume, speed of operation, reliability etc. It will be understood that changing the number of lobes in the cam surfaces changes the number of pumping cycles and that a pair of ports (inlet and exhaust) must be provided for each cycle. Also the manner of rotating the cam can be altered so that the linkages considered herein may use different mechanical methods. In addition, the specific cam surfaces employed may be altered depending upon the tolerable acceleration forces on the vanes. Additionally, the ports in the casing may be interconnected by integral passages so that only a single outlet and inlet are available. Furthermore the materials employed herein may be various metals including aluminum, steel, as well as various plastics and other suitable materials that can withstand the stresses and provided the desired reliability. Furthermore, the various shapes, volumes and dimensions of components illustrated herein can be varied depending upon the desired speed, volume, strength, reliability, weight, etc.

Obviously many modifications and variations of the present invention are possible in light of the above teachings, it is therefore to be understood that within the scope of the appended claims, the invention may be practiced otherwise than as specifically described.

What is claimed is:

1. A variable displacement vane pump comprising:

a ported casing having a pair of relatively rotatable complementary cams, each having a surface shaped to provide a curvilinear annular track;

a rotor rotatably mounted in said casing; and a first and second plurality of vanes mounted to be axially slidable upon said rotor, each of said vanes being sized and positioned to engage a corresponding one of said pair of cams, the vanes of the first plurality engaging one of the cams, the vanes of the second plurality engaging the other one of the cams.

2. A variable displacement vane pump, comprising:

a ported casing having a pair of relatively rotatable complementary cams, each having a surface shaped to provide a curvilinear annular track, a rotor rotatably mounted in said casing; and a first and second plurality of vanes mounted to be axially slidable upon said rotor, each of said vanes being sized and positioned to engage a corresponding one of said pair of cams, the vanes of the first plurality engaging one of the cams, the vanes of the second plurality engaging the other of the cams, and said vanes being grouped into a plurality of circumferentially spaced pairs, one from each of the first and second plurality, the vanes within each pair being positioned adjacently.

3. A pump according to claim 1 wherein each adjacent pair of said vanes are mounted in said rotor to inhibit fluid flow between the vanes.

4. A pump according to claim 2 wherein said casing comprises:

bias means for urging apart each adjacent pair of said vanes.

5. A pump according to claim 4 wherein said bias means comprises:

an inwardly peaked, annular, inside surface shaped to engage said vanes.

6. A pump according to claim 2 wherein said casing comprises:

an annular frame;

said complementary cams rotatably mounted on axially opposite sides of said frame, said rotor being journalled on at least one of said walls.

7. A pump according to claim 6 wherein said rotor has a plurality of equiangular, radial slots extending the full axial length of said rotor, said slots being sized to fit a pair of said vanes.

8. A pump according to claim 7 wherein each of said slots are sized to fit a partially overlapping pair of the vanes.

9. A variable displacement vane pump comprising:

a ported casing having a pair of relatively rotatable complementary cams, each having a surface shaped to provide a curvilinear annular track, with each of said cams having along its annular track a thickness that varies circumferentially but not radially;

a rotor rotatably mounted in said casing; and a first and second plurality of vanes slideably mounted to be axially slidable upon said rotor, each of said vanes being sized and positioned to engage a corresponding one of said pair of cams, the vanes of the first plurality engaging one of the cams, the vanes of the second plurality engaging the other one of the cams.

10. A variable displacement vane pump comprising:

a casing having at least one port and having a pair of complementary cams relatively rotatable in opposite directions with respect to said one port, and each having a surface shaped to provide a curvilinear annular track;

a rotor rotatably mounted in said casing; and a first and second plurality of vanes slidably mounted upon said rotor, each of said vanes being sized and positioned to engage a corresponding one of said pair of cams, the vanes of the first plurality engaging one of the cams, the vanes of the second plurality engaging the other one of the cams.

11. A pump according to claim 10 comprising:

linkage means connected to said cams for relatively rotating them in opposite directions with respect to said one port.

12. A pump according to claim 11 wherein the linkage means is operable to rotate said cams relatively equal amounts with respect to said one port.

13. A variable displacement vane pump comprising:

a casing having a pair of relatively rotatable complementary cams, each having a surface shaped to provide a curvilinear annular track, said casing having at least one inlet and outlet port and wherein said annular track has a thickness that various periodically in a circumferential direction;

a rotor rotatably mounted in said casing; and a first and second plurality of vanes slideably mounted upon said rotor, each of said vanes being sized and positioned to engage a corresponding one of said pair of cams, the vanes of the first plurality engaging one of the cams, the vanes of the second plurality engaging the other one of the cams.

14. A pump according to claim 13 wherein the number of inlet ports and the periods of variation in the thickness of said track are equal.

15. A pump according to claim 13 wherein said annular track is rotatable into a position where its maximum thickness is placed between two adjacent ports.

* * * * *